US009996031B2

(12) United States Patent
Luke

(10) Patent No.: US 9,996,031 B2
(45) Date of Patent: Jun. 12, 2018

(54) AUTHENTICITY INFORMATION CARRIER COUPLED TO FLOW STIMULATOR IN CARTRIDGE

(71) Applicant: HEWLETT-PACKARD DEVELOPMENT COMPANY, L.P., Houston, TX (US)

(72) Inventor: Jeffrey Harold Luke, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days. days.

(21) Appl. No.: 15/115,204

(22) PCT Filed: Apr. 30, 2014

(86) PCT No.: PCT/US2014/036049
§ 371 (c)(1),
(2) Date: Jul. 28, 2016

(87) PCT Pub. No.: WO2015/167494
PCT Pub. Date: Nov. 5, 2015

(65) Prior Publication Data
US 2016/0342110 A1 Nov. 24, 2016

(51) Int. Cl.
*G03G 15/00* (2006.01)
*G03G 15/08* (2006.01)
(Continued)

(52) U.S. Cl.
CPC ..... *G03G 15/0889* (2013.01); *B41J 2/1755* (2013.01); *B41J 2/17513* (2013.01);
(Continued)

(58) Field of Classification Search
CPC . B41J 2/17546; B41J 2/1755; G03G 15/0863; G03G 15/0889; G03G 21/1875
See application file for complete search history.

(56) References Cited

U.S. PATENT DOCUMENTS 6,240,262 B1 * 5/2001 Taniyama ..... G03G 15/0863 399/12
7,196,627 B2 3/2007 Rommelmann et al.
(Continued)

FOREIGN PATENT DOCUMENTS

CN 1480807 A 3/2004
CN 105659255 6/2016
(Continued)

OTHER PUBLICATIONS

English machine translation of Hymas et al. (CN 105659255 A), "Cartridge comprising an auto-destruct feature"; by Hymas, Scott; and Richards, Douglas; published Jun. 8, 2016.*
(Continued)

*Primary Examiner* — David M Gray
*Assistant Examiner* — Geoffrey T Evans
(74) *Attorney, Agent, or Firm* — HP Inc. Patent Department

(57) ABSTRACT

A cartridge (1) to connect to a printer, the cartridge comprising a powder reservoir (2), a carrier (5) holding authenticity information (7, 9), a powder flow stimulator (3) in or near the reservoir (2), coupled to the carrier (5) so that a first stimulator movement displaces at least part of the carrier (5).

20 Claims, 4 Drawing Sheets

(51) Int. Cl.
*B41J 2/175* (2006.01)
*G03G 21/18* (2006.01)

(52) U.S. Cl.
CPC ..... *B41J 2/17546* (2013.01); *G03G 15/0863* (2013.01); *G03G 21/1875* (2013.01)

(56) References Cited

U.S. PATENT DOCUMENTS

| | | | |
|---|---|---|---|
| 7,809,287 | B2 | 10/2010 | Okamura |
| 7,962,051 | B2 | 6/2011 | Kim |
| 8,588,625 | B2 | 11/2013 | Okamoto |
| 2009/0087198 | A1 | 4/2009 | Okamura |
| 2011/0128567 | A1 | 6/2011 | Cachia et al. |

FOREIGN PATENT DOCUMENTS

| | | | |
|---|---|---|---|
| GB | 2233278 | A | 1/1991 |
| JP | 2004294646 | A | 10/2004 |
| JP | 10-2006-0003432 | A | 1/2006 |
| JP | 2008164665 | A | 7/2008 |
| KR | 10-2004-0006406 | A | 1/2004 |
| KR | 10-2006-0059668 | A | 6/2006 |
| KR | 10-2007-0072231 | A | 7/2007 |

OTHER PUBLICATIONS

HP; Don't Mistake a Counterfeit for Original HP Toner; Jan. 24, 2013; http:www.hp.com/global/us/en/counterfeit-toner/.

* cited by examiner

AUTHENTICITY INFORMATION CARRIER COUPLED TO FLOW STIMULATOR IN CARTRIDGE

BACKGROUND

Sometimes it is desirable to distinguish original cartridges provided by original equipment manufacturers (OEMs) from third party compatible cartridges, the latter being alternative cartridges compatible to a corresponding OEM printer that is designed to use original OEM cartridges. An OEM printer that uses a third party compatible cartridge may provide a printed product of less or different quality than OEM cartridges. Therefore, an OEM typically wants to avoid association with such third party.

In certain instances, the third party compatible cartridge is a replicate or counterfeit cartridge that has the appearance of an original OEM cartridge. In other instances, original OEM cartridges housing can be refilled, reused or tampered with by third parties after the original contents have been exhausted. In all of the above instances, it is desirable that the third party contents can be readily distinguished from original OEM contents, by an end user or operator.

BRIEF DESCRIPTION OF THE DRAWINGS

For the purpose of illustration, certain examples constructed in accordance with this disclosure will now be described with reference to the accompanying drawings, in which.

DETAILED DESCRIPTION

In the following detailed description, reference is made to the accompanying drawings. The examples in the description and drawings should be considered illustrative and are not intended as limiting to the specific example or element described. Multiple examples can be derived from the following description and drawings through modification, combination or variation of the different elements.

In this disclosure a printer can be any dispense device that provides a printed product by printing. Examples of such printers include electro-photographic printers and three-dimensional (3D) printers. For example, the printer is to dispense certain consumables to obtain a printed product, wherein the consumable can be a powder such as toner powder or 3D printing powder. The print consumable is held in a cartridge. The cartridge is a container that is adapted to be installed in a printer, and replaced after being substantially exhausted. Herein, OEMs (Original Equipment Manufacturers) provide such printer and corresponding cartridges. For example a brand name or logo on the printer may correspond to a brand name or logo on the cartridge 1. In this disclosure, authenticating a cartridge 1 includes verifying and confirming that the cartridge 1 and its contents are provided by the same OEM as the printer, or by an OEM approved party.

Figure 1:
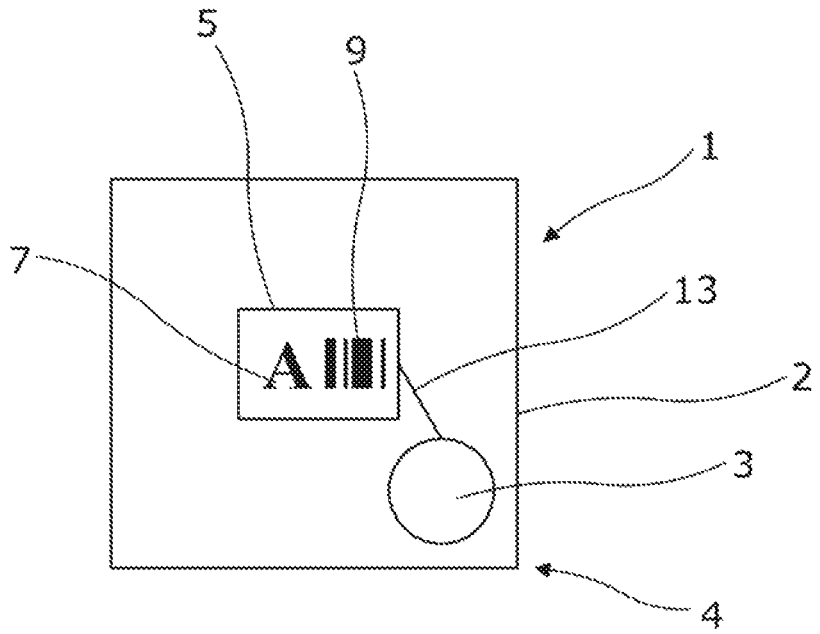
FIG. 1 illustrates a diagram of an example of a printer cartridge before stimulator movement.

FIG. 1 illustrates an example of a cartridge 1 that is to be connected to a printer. The cartridge 1 includes a reservoir 2 formed by at least one wall that encloses a powdered print consumable such as 3D printing powder or toner powder. In the reservoir 2 a powder flow stimulator 3 is provided that is to stimulate the flow of powder out of the reservoir 2, for example towards a gate 4 that may be positioned near a bottom of the reservoir 2 in a normal installation orientation of the reservoir 2. The powder flow stimulator 3 is moveable, for example rotatable. In one example, the flow stimulator 3 includes a rotating shaft and may have wings. In another example, the flow stimulator includes a vibrating element. For example the flow stimulator 3 is a powder stirrer or agitator. The flow stimulator 3 can be coupled to external cartridge transmission parts such as gears or protruding shafts that are to be connected to transmission parts of a corresponding printer. Hence, in operation the powder flow stimulator 3 is driven, indirectly, by a printer motor and transmission.

The cartridge 1 includes an information carrier 5. The carrier 5 can be plate or label shaped. For example the carrier 5 is a flexible label. The carrier 5 can be located within the reservoir 2. The carrier 5 can be at least partly adhered against an interior wall of the reservoir 2.

The carrier 5 includes authenticity information 7, 9. The carrier 5 is located and adapted to allow reading of the information 7, 9 from outside of the reservoir 2, for example through a window. In one example, the authenticity information 7, 9 is visibly printed, imprinted or embossed on the carrier 5. In the illustrated example the authenticity information 7, 9 includes at least one of a printed logo 7 and an optical authentication code 9 such as a bar code or QR (Quick Response) code. In another example the carrier 5 includes a wireless communication circuit that stores the authentication code. The circuit includes a non-volatile, non-transient memory to store the authentication code. The memory may be a read-only or re-writable memory. For example, the circuit includes an unpowered near field communication chip. For example the circuit is integrated with and/or adhered to the carrier 5. Such wireless readable circuit is readable from outside the cartridge 1 by a wireless scanning device.

In some of the mentioned examples, the carrier 5 is designed to allow contactless scanning of the authentication code 9 by a third party scan device that is not the printer. Such third party scan device can be a handheld, mobile computing device such as a smart phone or tablet that has a respective scan capability, or a dedicated scan device. For example, said capability allows for scanning the authentication code 9 according to at least one suitable standard technique including RFID (Radio Frequency Identification), NEC (Near Field Communication), IR (Infrared), or Optical Scanning techniques such as bar codes, QR codes, etc. Depending on the chosen scan standard, the capability may include an optical sensor, such as a camera, or an NFC or RFID transmitter. The capability may further include a set of decoding instructions stored on a memory of the respective device or a distant network-connected memory.

The different example authenticity verification codes mentioned in this disclosure can be configured according to any suitable contactless or proximity machine reading standard including but not limited to one or a combination of NFC (e.g. ISO/IEC 14443, ISO/IEC 18092, ISO/IEC 21481, ECMA-340, ECMA-352), RFID (e.g. ISO/IEC 14443, ISO/IEC 18000, ISO/IEC 15693, ISO/IEC 18092, ISO/IEC 21481), proximity card reading (e.g. ISO/IEC 14443, ISO/IEC 15693), bar coding (e.g. ISO/IEC 15416, ISO/IEC 15415), QR coding (e.g. ISO/IEC 18004:2000, ISO/IEC 18004:2006) and other contactless code reading technologies.

The authentication code 9 allows for a user or operator to verify that the consumable material is from a trusted source by contactless scanning of the code 9 by a device other than a printer, and matching it with a corresponding comparison code. Such comparison code may be stored on a distant computing device other than the printer, in one example on a distant network connected server, for example in a list containing multiple comparison codes. For example, the decoded authentication code 9 corresponds to a unique identity of the product, for example a serial number. A positive authentication of the cartridge 1 and its contents confirms that the cartridge 1 is not a third party cartridge. Hence, the carrier 5 facilitates distinguishing third party cartridges from original OEM cartridges.

According to these different examples, the original cartridge 1 can be authenticated before a first installation by including at least one of the following steps (i) human reading a company logo and associating the logo with an OEM or OEM-authorized party, (ii) optically reading an optical scanning code with an optical reading device and associating the code with an OEM or OEM-authorized party, and (iii) wirelessly reading the wireless communication circuit with the aid of a wireless reading device such as a radio communication device and associating the read information with an OEM or OEM-authorized party.

Figure 2:
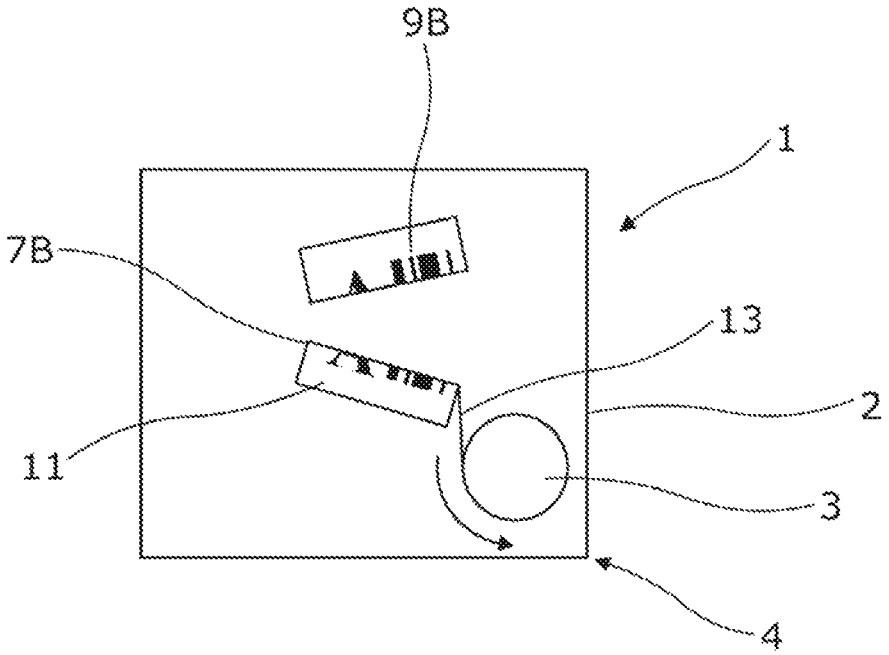
FIG. 2 illustrates a diagram of the example of the printer cartridge of FIG. 1 after a stimulator movement.

The powder flow stimulator 3 and carrier 5 may be located in the reservoir 2. The carrier 5 with authenticity information is mechanically coupled to the flow stimulator 3. For example the carrier 5 is directly coupled to the flow stimulator 2 or coupled by a strand 13, so that a movement of the flow stimulator 2 displaces at least part of the carrier 5, as illustrated in FIG. 2. For example, the flow stimulator 3 pulls the strand when it starts to move, hence pulling a portion of the carrier 5. FIG. 2 illustrates an example of a carrier 5 after flow stimulator movement wherein part of the carrier 5 is moved with respect to another part of the carrier 5 thereby tearing the carrier 5 so that the logo 7*b* and bar code 9*b* are visibly altered, for example rendered undetectable by a machine.

After installing the cartridge 1 for a first time, a printing or calibration process can be initiated whereby the flow stimulator 3 is rotated or otherwise moved in order to stimulate flow of the powder in the reservoir 2. Such first flow stimulator rotation displaces at least a part 11 of the carrier 5. Thereby the carrier 5 may displace, rupture, divide, unravel or tear so that the authenticity information is visibly altered. As a consequence, subsequent authentication is inhibited. A continued flow stimulator rotation may further displace, tear, destroy or unravel the carrier 5, for example in such a manner that the original authenticity information is rendered unreadable by man or machine. In another example the logo 7 is altered so that the alteration is visible by a human while the original authentication code 9 is rendered undetectable by a scanning device.

Figure 3:
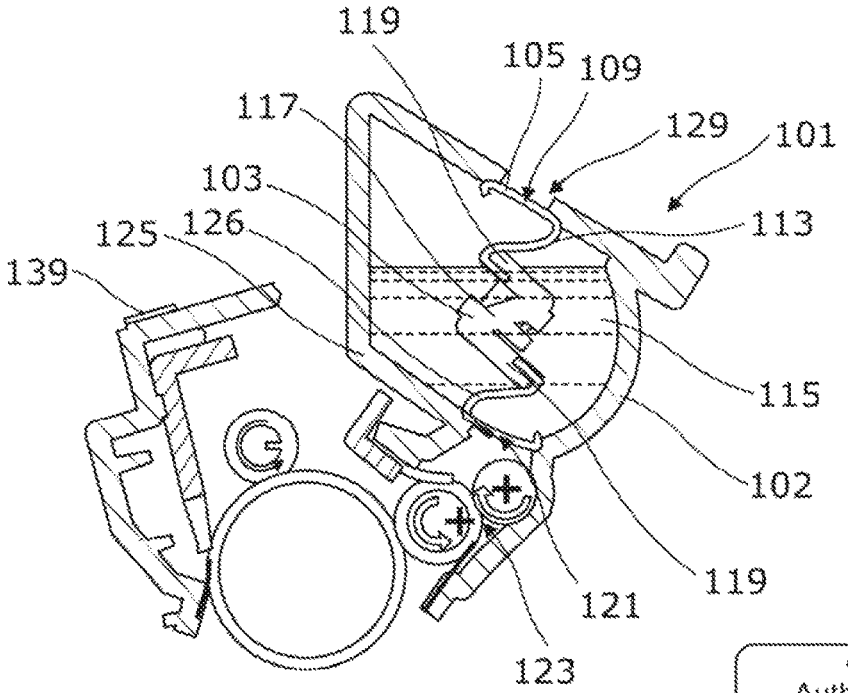
FIG. 3 illustrates a diagram of another example of a printer cartridge before stimulator movement.

FIG. 3 is an example of a toner cartridge 101. The toner cartridge 101 includes a powder reservoir 102 containing powder 115. A stirrer 103 is provided in the powder reservoir 102 to stimulate flow of the powder 115 out of the reservoir 102. In the example of FIG. 3 the stirrer 103 is in an initial orientation before a first rotation. The stirrer 103 is to rotate about a rotation axis 117. The stirrer 103 includes wings 119 to aid in moving the powder out of the reservoir 102. The reservoir 102 includes a reservoir gate 121. An imaging roller assembly 123 is disposed on the opposite side of the gate 119. The imaging roller assembly 123 may include a developer roller, a charger roller and a developer roller. A seal 125 or dam may be provided between the roller assembly 123 and powder reservoir 102 to seal the gate 121. The seal 125 may be adhered to inner walls of the cartridge 101 around the gate 121. For example the seal 125 includes a film or plate like structure. The seal 125 is coupled to the stirrer 103, for example by a second strand 126.

The cartridge 101 includes a window 129. The window 129 is located in a reservoir wall. The window 129 may be defined by an opening through the reservoir wall and a transparent material that covers the opening. The material is transparent so as to allow optical reading of authenticity information that is held against the window 129. The transparent material may include glass and/or polymer. The cartridge 101 includes a carrier 105 for carrying authenticity information such as an authentication code 109. The carrier 105 may be a label. The carrier 105 is positioned close to or against the window 129. The carrier 105 is adhered against or around the window 129 with its printed side facing the window 129 to allow the authenticity information to be read through the window 129, for example by a human or a scanning device. The carrier 105 is positioned so that powder 115 in the reservoir 102 does not affect a readability of the authenticity information.

Figure 4:
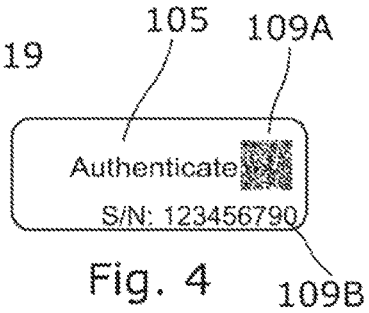
FIG. 4 illustrates an example of a label including authenticity information of the printer cartridge of FIG. 3.

FIG. 4 illustrates an example of a label-like carrier 105 with authenticity information. The authenticity information includes optical authentication codes 109A, 109B. A first authentication code 109A is a human readable serial number and a second authentication code 109B is a QR code to be read by a device with QR scanning capability, such as a smart phone, tablet or phablet. Before installation of the cartridge 101 in a printer, the authentication codes 109A, 109B are readable by a human and a scanning device, respectively, through the window 129. For example each of the codes 109A, 109B may be manually entered or scanned and thereafter compared with a corresponding verification code stored on a distant server.

Turning again to FIG. 3, in a further example, a non-volatile, non-transient digital memory 139 is provided on the cartridge 201. The memory is part of an interconnect circuit to communicate the information stored thereon to a printer controller. The memory 139 stores a third authentication code that is to allow verification of an authenticity of the cartridge 201 by the printer. The third authentication code may include a unique identifier, for example a product serial number or the like. The third authentication code may include encrypted information. For example, the third authenticity verification code is to be matched to at least one corresponding second comparison code stored in the printer or on a network memory. For example the memory 139 is to remain functional, at least until the cartridge life fully or partly emptied or until the end of life of the cartridge 101. This type of additional authenticity information may be read or transmitted by the printer, rather than by a non-printing scanning device.

The carrier 105 is coupled to the stirrer 103. For example the carrier 105 is coupled to the stirrer 103 by a strand 113 or the like. For example the coupling strength of the carrier 105 to the window 129 or to the inner walls of the reservoir 102 is less than the coupling strength of the carrier 105 to the stirrer 103 so that portions of the carrier 105 are released from their respective adhesion locations by a first movement of the stirrer 103.

Figure 5:
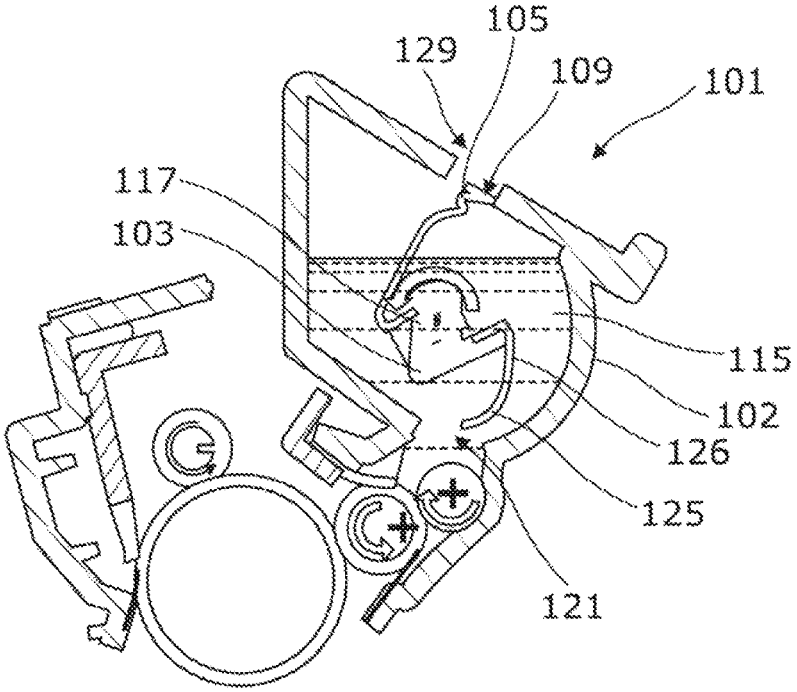
FIG. 5 illustrates a diagram of the example printer cartridge of FIG. 3 during a first stimulator movement after a first cartridge installation.

FIG. 5 illustrates the cartridge 101 after a first stirrer movement around the rotational axis 117. For example the stirrer 103 may have rotated over approximately 90 degrees or less. By this first stirrer movement, the stirrer 103 displaces at least a part of the carrier 105. As can be seen, the carrier 105 is partly wound around part of the stirrer 103, and partly or fully detached from its respective original adhesion location. The rotational movement of the stirrer 103 displaces part of the carrier 105 so that reading of the authenticity information thereon is inhibited.

Figure 6:
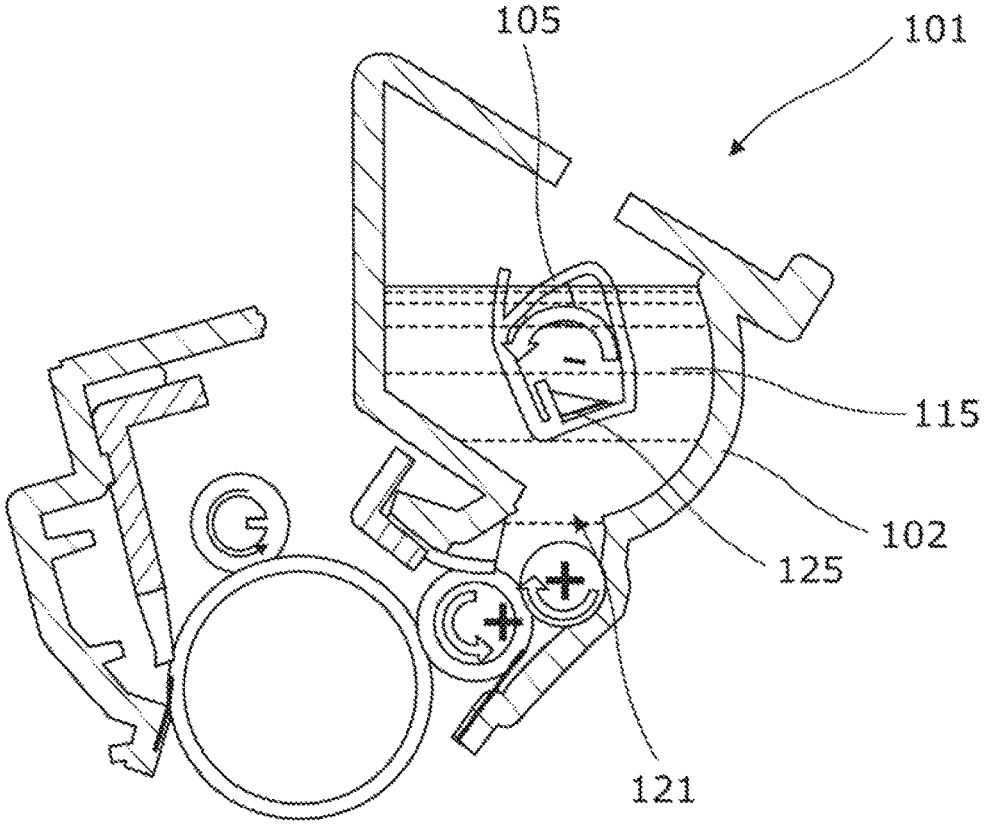
FIG. 6 illustrates a diagram of the example printer cartridge of FIGS. 3 and 5 after continued stimulator movement.

FIG. 6 illustrates the cartridge 101 after further rotation, for example after at least one full rotation of the stirrer 103. For example the carrier 105 is wound around the stirrer 103 and thereby (i) completely decoupled from the respective reservoir interior walls and (ii) invisible through the window 129. Hence, the authentication codes 109A, 109B are rendered unreadable from outside the cartridge 101.

Figure 7:
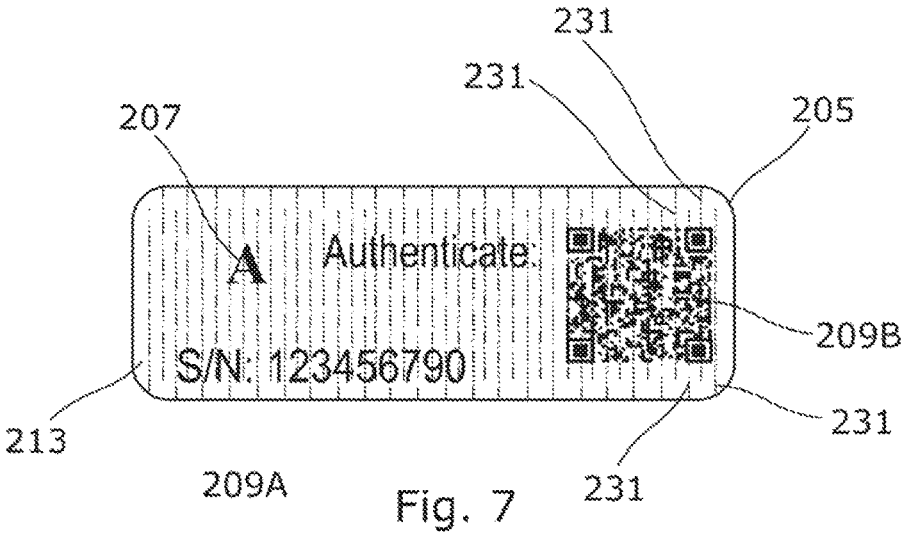
FIG. 7 illustrates an example of a label including grooves.

FIG. 7 illustrates an example of a label 205 having authenticity information printed thereon, in the form of a logo 207, a serial number 209A and a QR code 209B. For example, the label 205 may comprise strengthened, coated paper and/or flexible, fiber strengthened polymer material. In an example, the authenticity information side of the label 205 faces a window so as to be visible from outside a cartridge, as described above. The label 205 includes cut out grooves 231 arranged in a staggered fashion extending from a longitudinal edge of the label 205 towards an opposite longitudinal edge up to a small distance from said opposite longitudinal edge. The grooves 231 may completely or partly cut through the label 205 to allow the label 205 to be unraveled along the grooves 231. The grooves 231 form a single strand within the label 205 that is arranged in a snake-like fashion. Each of the grooves 231 may be formed by a dotted or straight line. The grooves 231 facilitate that by pulling a corner 213 or end of the label 205, the label 205 is unraveled along the grooves 231 as if it were a single strand. By connecting said corner 213 or end to the stirrer, the label 205 is wound around the stirrer and unraveled at the same time. Hence, the authenticity information 207, 209A, 209B can be rendered unreadable in a relatively controlled manner.

Figure 8:
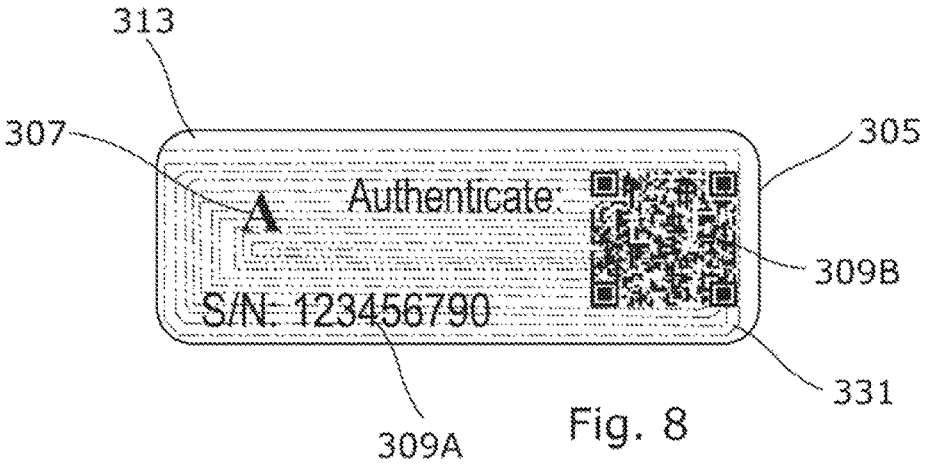
FIG. 8 illustrates another example of a label including grooves.

FIG. 8 illustrates another example of a label 305 having authenticity information printed there one, in the form of a logo 307, a serial number 309A and a QR code 309B. For example, the label 305 may comprise strengthened, coated paper and/or flexible, fiber strengthened polymer material. In an example, the authenticity information side of the label 305 faces a window so as to be visible from outside a cartridge. The label 305 includes a cut out groove 331 arranged in a spiraled fashion thereby allowing the label 305 to be unraveled as if it were a single strand. The groove 331 may completely or partly cut through the label 305. The groove 331 forms a spiraled single strand in the label 305 and facilitates that by pulling a corner 313 of the label 305, the label 305 is unraveled along the groove 331. By connecting said corner 313 to the stirrer, the label 305 is unraveled around the stirrer during winding. Hence, the authenticity information 307, 309A, 309B can be rendered unreadable in a relatively controlled manner.

Figure 9:
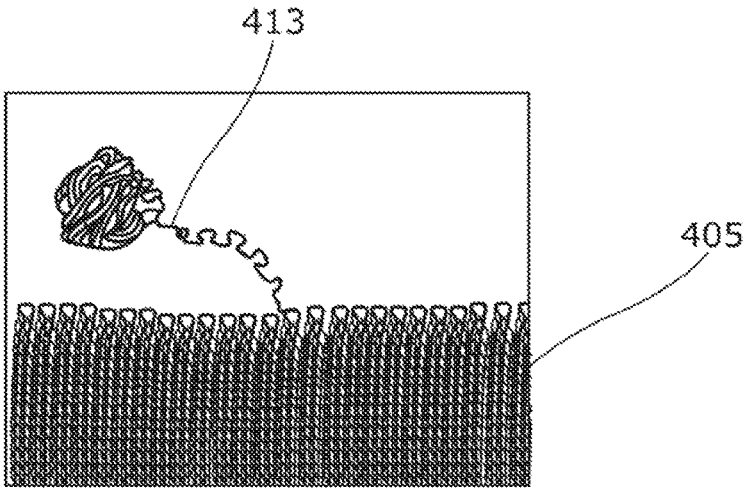
FIG. 9 illustrates an example of a label material.

FIG. 9 illustrates an example of a label that includes a woven strand to allow for controlled unravelling similar to FIGS. 7 and 8. For example the label material includes a woven fabric. The fabric may include at least one of textile and polymer material. A suitable weaving pattern may be chosen to facilitate unraveling. A strand's end 413 may protrude from the woven label 405 and attached to a flow stimulator so that when the flow stimulator pulls the strand, the label 405 is unraveled.

Although only examples of optical authentication codes are illustrated, the same principles may apply to a wireless authentication code stored on a circuit in the carrier. A carrier carrying such authentication circuit may be at least partly displaced by a flow stimulator movement, hence rendering the authentication code stored on such wireless circuit unreadable. For example, such circuit can be broken or deformed by unravelling the carrier, so that thereafter the authentication code cannot be read by a respective scanning device such as a smart phone, tablet phablet or dedicated scanning device.

With the examples described in this disclosure a cartridge that has non-OEM powder may be detected relatively easily because the authenticity information will be altered in a way that is relatively easy to read by man or machine. Only before a first installation of the original OEM cartridge, the cartridge can be authenticated by the disclosed authenticity information, and afterwards not anymore. Furthermore, by scanning the authentication code with a network connected device it may be possible for an OEM to assign certain rewards to users of first-time installed original cartridges containing original OEM-approved powder, while avoiding assigning of rewards to users of non-OEM powders.

The invention claimed is:

1. A cartridge to connect to a printer, the cartridge comprising a powder reservoir, a carrier, disposed inside the powder reservoir, holding authenticity information to be read from outside the cartridge, a powder flow stimulator in or near the powder reservoir, coupled to the carrier so that a first stimulator movement displaces at least part of the carrier.

2. The cartridge of claim 1 wherein the powder flow stimulator and carrier are coupled so that continued flow stimulation renders the information unreadable.

3. The cartridge of claim 1 wherein the powder flow stimulator is a stirrer and the movement includes rotation.

4. The cartridge of claim 3 wherein the carrier is a label and the label is coupled to the stirrer.

5. The cartridge of claim 4 wherein the stirrer is to wind the label.

6. The cartridge of claim 1 wherein the carrier is a label that includes grooves, so that the label is unraveled by stimulator movement.

7. The cartridge of claim 1 wherein the carrier includes woven material that is unraveled by stimulator movement.

8. The cartridge of claim 1 further comprising a window, wherein before the displacement the information is visible from outside the cartridge through the window and the displacement inhibits optical reading of the information.

9. The cartridge of claim 1 wherein the information includes an authentication code to authenticate a source of the consumable material and the code is to be read by a device other than a printer.

10. The cartridge of claim 9 wherein the authentication code is an optical code and the device is an optical reader.

11. The cartridge of claim 1 further comprising a memory circuit storing an authentication code other than the authenticity information to be communicated to a printer through an interconnect circuit.

12. The cartridge of claim 1 wherein the authenticity information includes both of a printed logo and an optical authentication code.

13. The cartridge of claim 12 wherein the optical authentication code[s] comprises a bar code or Quick Response (QR) code.

14. The cartridge of claim 1 wherein the carrier comprises a wirelessly readable circuit, the authenticity information being stored electronically in the wirelessly readable circuit, and wherein the stimulator movement renders the circuit no longer wirelessly readable.

15. The cartridge of claim 1 wherein the powder flow stimulator comprises a vibrating element.

16. The cartridge of claim 1 wherein the carrier comprises a cut out groove arranged in a spiraled fashion so that stimulator movement unravels the carrier.

17. A printer cartridge comprising powder reservoir, a powder flow stimulator in the reservoir, and a label including authenticity information, wherein the label is coupled to the powder flow stimulator so that the label is at least partly disassembled at stimulator movement thereby inhibiting further authentication.

18. The printer cartridge of claim 17 further comprising a window, wherein the authenticity information comprises an authentication code that is visible from outside the cartridge through the window, and the authentication code is to be scanned by a device other than the printer.

19. A printer cartridge comprising a powder reservoir, a powder flow stimulator in the reservoir, and a label including authenticity information, wherein the label is coupled to the powder flow stimulator so that the label at least partly displaces at stimulator movement thereby inhibiting further authentication;

wherein the label is constructed to facilitate unraveling of the label by stimulator movement.

20. The printer cartridge of claim 19 wherein the label is coupled to the powder flow stimulator by a strand and the powder flow stimulator is to unravel the label by winding the strand.

* * * * *